US006631768B2

(12) United States Patent
Patel et al.

(10) Patent No.: US 6,631,768 B2
(45) Date of Patent: Oct. 14, 2003

(54) EXPANDABLE SHIFTING TOOL

(75) Inventors: Dinesh R. Patel, Sugar Land, TX (US); Dennis M. Read, Jr., Manvel, TX (US); Ricardo Martinez, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 102 days.

(21) Appl. No.: 09/851,642

(22) Filed: May 9, 2001

(65) Prior Publication Data

US 2002/0166667 A1 Nov. 14, 2002

(51) Int. Cl.[7] ..... E21B 23/04
(52) U.S. Cl. ..... 166/373; 166/332.4; 166/237
(58) Field of Search ..... 166/373, 381, 166/332.4, 237, 217

(56) References Cited

U.S. PATENT DOCUMENTS

| | | | | |
|---|---|---|---|---|
| 2,805,718 A | | 9/1957 | Tausch | |
| 2,862,564 A | | 12/1958 | Bostock | |
| 3,115,188 A | * | 12/1963 | Cochran et al. | |
| 3,185,219 A | | 5/1965 | Grimmer et al. | |
| 3,190,360 A | * | 6/1965 | Farley | |
| 3,311,173 A | * | 3/1967 | Henslee, Jr. et al. | |
| 3,827,493 A | | 8/1974 | Terral | |
| 4,124,070 A | | 11/1978 | King et al. | |
| 4,917,191 A | | 4/1990 | Hopmann et al. | |
| 5,090,481 A | | 2/1992 | Pleasants et al. | |
| 5,156,210 A | | 10/1992 | Roth | |
| 5,348,090 A | | 9/1994 | Leismer | |
| 5,355,953 A | | 10/1994 | Shy et al. | |
| 5,413,173 A | * | 5/1995 | Mills et al. | 166/212 |
| 5,549,161 A | | 8/1996 | Gomez et al. | |
| 5,765,640 A | | 6/1998 | Milne et al. | |
| 6,024,173 A | | 2/2000 | Patel et al. | |
| 6,026,899 A | | 2/2000 | Arizmendi et al. | |
| 6,050,341 A | | 4/2000 | Metcalf | |
| 6,199,632 B1 | * | 3/2001 | Shy | 166/242.6 |
| 6,283,208 B1 | * | 9/2001 | George et al. | 166/255.3 |

FOREIGN PATENT DOCUMENTS

| | | |
|---|---|---|
| GB | 2213181 | 8/1989 |
| GB | 2275070 | 8/1994 |

* cited by examiner

*Primary Examiner*—William Neuder
(74) *Attorney, Agent, or Firm*—Williams, Morgan & Amerson P.C.; Jeffrey Griffin; Brigitte Jeffery

(57) ABSTRACT

Embodiments of the present invention disclose apparatus and methods that can be used to mechanically actuate a downhole tool with an expandable shifting tool. One embodiment of the invention is an expandable shifting tool comprising a housing having an outer diameter and a plurality of radially extendable elements. The radially extendable elements are longitudinally separated from each other and each extendable element is at least partially contained within the housing. The extendable elements are capable of moving between an extended position and a retracted position and are biased towards the extended position.

49 Claims, 6 Drawing Sheets

EXPANDABLE SHIFTING TOOL

BACKGROUND OF THE INVENTION

1. Field of the Invention

This invention relates generally to tools used to complete subterranean wells. More particularly the present invention describes a shifting tool that can be used to actuate a downhole device.

2. Description of Related Art

Hydrocarbon fluids such as oil and natural gas are obtained from a subterranean geologic formation, referred to as a reservoir, by drilling a well that penetrates the hydrocarbon-bearing formation. Once a wellbore has been drilled, the well must be completed before hydrocarbons can be produced from the well. A completion involves the design, selection, and installation of equipment and materials in or around the wellbore for conveying, pumping, or controlling the production or injection of fluids.

While completing a well or performing subsequent remedial work, downhole tools requiring mechanical actuation are often used. The mechanical actuation can be used to perform numerous types of actions, for example, setting or releasing a downhole tool or reconfiguring a tool, such as opening or closing a valve.

Shifting tools of various kinds are commonly used in the industry and known to those skilled in the art. In general a shifting tool allows a force exerted on the shifting tool to be transferred to a separate downhole tool, thus providing the needed force to operate a mechanical actuation. A simple example of a shifting tool used to perform a mechanical actuation would be a tool having a set of jars and a contact device having a profile, the tool being used to shift a sliding sleeve into a different position. The contact device profile can be sized to pass through the well tubulars but to land on a reduced diameter profile of the sliding sleeve. The contact device and jars can be run into the well until the contact device profile lands on the sliding sleeve profile, force from the jars can then be transferred through the contact device onto the sliding sleeve profile, thus imparting force onto the sliding sleeve and moving the sliding sleeve to a different configuration.

A problem that is frequently confronted is the need to pass a shifting tool through well tubulars having reduced interior diameters. The simple example described above would not work below a tubular having a reduced diameter. One means that has been employed to overcome this problem has utilized expandable elements such as inflatable packers that can pass through the restricted diameter portion in a deflated position. Once in its desired location, the packer element can be inflated to a sufficient extent that it sets within the downhole tool and can then be used as a shifting tool to transfer force and enable the mechanical actuation of the downhole tool. Once the actuation has been completed, the inflatable element can be deflated and removed from the well. A drawback to the use of inflatable elements for this application is the possibility that the inflatable element will not deflate to the extent needed to pass through the restricted diameter upon removal from the well. If the expandable element does not deflate fully or if it is damaged in some way it may not be possible to remove the shifting tool from the well. If this happens the restricted diameter tubular may have to be removed from the well or even more extensive and costly recovery measures taken.

Another prior art means of engaging a downhole tool below a restriction involves utilizing an expanding mechanical shifting tool having slip elements located in the same plane. After the shifting tool has passed through the restriction, the tool can then be expanded to a larger diameter in an attempt to engage the downhole tool. This type of shifting tool has limitations on the extent of expansion that can be achieved.

Despite the use of prior art features, there remains a need for an improved expandable shifting tool.

SUMMARY OF THE INVENTION

One embodiment of the present invention is an expandable shifting tool comprising a housing having an outer surface and a plurality of radially extendable elements longitudinally separated from each other. The extendable elements are capable of moving between an extended position and a retracted position. The extendable elements can be at least partially contained within the housing and can be biased towards the extended position.

The extendable elements can comprise a first surface and a second surface, the first surface comprising an end of the extendable element that protrudes outside of the housing outer surface when in its extended position. When in the fully retracted position the first surface extends no further axially than the outer surface of the housing. The second surface of the extendable element extends no further axially than the housing outer surface when the extendable element is in its retracted position. The housing can comprise a wall having openings that enable the second surface of the extendable element to be located within the wall opening when the extendable element is in its retracted position. Each extendable element is capable of protruding beyond the housing outer surface a distance greater than 50 percent of the housing outer surface diameter length. Each extendable element can be located on the opposite side of the tool from an adjacent extendable element.

The housing may be cylindrical in shape, and the shifting tool can comprise a first and second end, having at least one passageway capable of communicating fluid between the first end and the second end within the shifting tool housing. The first end can comprise a connection that is capable of connecting to deployment device while the second end can comprise fluid outlet ports capable of discharging fluid from the passageways through the tool. The extendable elements and tool housing may comprise alignment elements that guide the extendable elements as they move between their retracted and extended positions. Each extendable element is capable of moving between the retracted and extended position independent of any other extendable element. The first surface of the extendable element can comprise a profile that is capable of engaging a mating profile. Each extendable element first surface profile can be different than the first surface profiles of the other extendable elements.

Another embodiment is a shifting tool comprising a generally cylindrical housing having a wall, an outer diameter, a first end and a second end. A plurality of anchor slips at least partially located within the housing and comprising an first surface and a second surface, are located in separate radial planes from each other and are capable of moving independently between a retracted position and an extended position. At least one longitudinal passageway is within the housing capable of providing hydraulic communication between the first end and the second end of the tool. The anchor slips in their extended position are each capable of extending beyond the outer diameter of the housing a distance in excess of 50 percent of the housing diameter.

The anchor slips can be biased towards the extended position and comprise alignment elements that guide the anchor slips as they move between their retracted and extended positions. In their retracted position the anchor slips do not extend beyond the outer diameter of the tool housing in some embodiments. The tool housing can comprise openings within its wall that are capable of containing a portion of the second surface of an anchor slip when the anchor slip is in its retracted position.

Yet another embodiment is a shifting tool comprising a generally cylindrical housing comprising a wall and an outer diameter. A plurality of latching members are at least partially disposed within the housing, the latching members being capable of moving independently between an inner position and an outer position, thereby defining a tool diameter. When the latching members are in their outer position the tool diameter is capable of being in excess of 150 percent of the housing diameter. The shifting tool can also contain latching members comprising a profile that is capable of engaging a mating profile, each latching member profile can be different than the other latching member profiles. The latching members may be biased to the outer position with a spring element and comprise alignment lugs that guide the latching members as they move between their inner and outer positions.

Each latching member can be located in separate radial planes from the other latching members. When a latching member is in its inner position, it is possible for the latching member to be contained within the housing outer diameter. The housing wall may comprise openings wherein when a latching member is in its inner position a portion of the latching member is located within the opening of the housing wall. At least one passageway can exist longitudinally through the tool within the housing providing fluid communication through the tool. The tool can comprise a first end and a second end, the first end having a coupling capable of connecting to a deployment device and the second end comprising at least one nozzle capable of discharging fluid from the at least one passageway.

Still another embodiment of the present invention is a downhole assembly comprising a shifting tool and a downhole profile. The shifting tool comprises a housing having an outer diameter and a plurality of radially extendable slips longitudinally separated from each other. Each slip is at least partially contained within the housing, outwardly biased and capable of acting independently. The downhole profile is adapted to releasably engage with the shifting tool. The shifting tool slips may comprise a profile that engages with a matching profile contained in the downhole profile. The shifting tool may comprise at least one fluid passageway within its housing capable of communicating fluid through the shifting tool.

One embodiment of the invention is a method of actuating a downhole tool comprising providing an expandable shifting tool comprising a plurality of axially extending elements that are longitudinally separated from each other. The shifting tool is inserted within the downhole tool and a profile on the extending elements engages with a matching profile on the downhole tool. Force is then applied to the shifting tool that is transferred to the downhole tool, thus actuating the downhole tool. The extending elements can be biased in an outward position and each extending element may have a different profile than the other extending elements. The shifting tool can comprise at least one passageway whereby fluid can be circulated through the shifting tool to wash the shifting tool down to the downhole tool.

Yet another embodiment is an apparatus comprising a housing and a plurality of slip elements longitudinally spaced from each other and capable of extending radially from the housing. Each slip comprises a profile that is capable of engaging a matching downhole profile. The slip elements are capable of being spaced at about 90 to about 180 degree phasing from the adjacent slip elements. The apparatus can comprise a first end and a second end and at least one passageway capable of communicating fluid between the first end and the second end within the apparatus housing.

Still another embodiment is a method of actuating a downhole tool by providing an expandable shifting tool comprising a plurality of radially extending elements that are longitudinally separated from each other. The shifting tool is inserted within the downhole tool where a profile on the extending elements engage with a matching profile on the downhole tool. Force is applied to the shifting tool that is transferred to the downhole tool, thus actuating the downhole tool. The extending elements can be biased in an outward position and each extending element can have a different profile than the other extending elements. The shifting tool can comprise at least one passageway whereby fluid can be circulated through the shifting tool to wash the shifting tool down to the downhole tool.

Another embodiment is a method of actuating a downhole tool located below a restricted diameter tubular comprising providing an expandable and collapsible mechanical shifting tool. The shifting tool comprising a plurality of outwardly biased slips, the slips spaced in radially separated planes. The shifting tool is inserted through the restricted diameter tubular and to the downhole tool. The slips of the shifting tool engage with the downhole tool. Movement of the shifting tool actuates the downhole tool, after which the shifting tool is disengaged from the downhole tool and passes through the restricted diameter tubular. The outer surfaces of the slips may comprise a profile that is capable of releasably engaging with a matching profile in the downhole tool. Each slip may comprise a profile with a different pattern than the other slips. Fluid may be circulated through at least one passageway within the shifting tool to wash the shifting tool down to the downhole tool.

Yet another embodiment of the invention is a method of actuating a downhole tool located in a wellbore that is deviated from vertical. This method comprises providing an expandable shifting tool comprising a housing having an outer diameter and at least two extendable dog elements. Each dog element is capable of extending beyond the housing outer diameter. The shifting tool is inserted into the wellbore, engaged with the downhole tool and the downhole tool is actuated. The shifting tool can be located eccentrically within the downhole tool. Fluid may be circulated through at least one passageway within the shifting tool to wash the shifting tool down to the downhole tool. The extendable dog elements may comprise a profile that releasably engages with a matching profile on the downhole tool. One side of the shifting tool can be in contact with the downhole tool, but each dog element is capable of engaging with the matching profile on the downhole tool.

It is to be noted however, that the appending drawings illustrative only typical embodiments of this invention and are therefore not to be considered limiting of its scope, for the invention may admit to other equally effective embodiments.

DESCRIPTION OF ILLUSTRATIVE EMBODIMENTS

Figure 1:
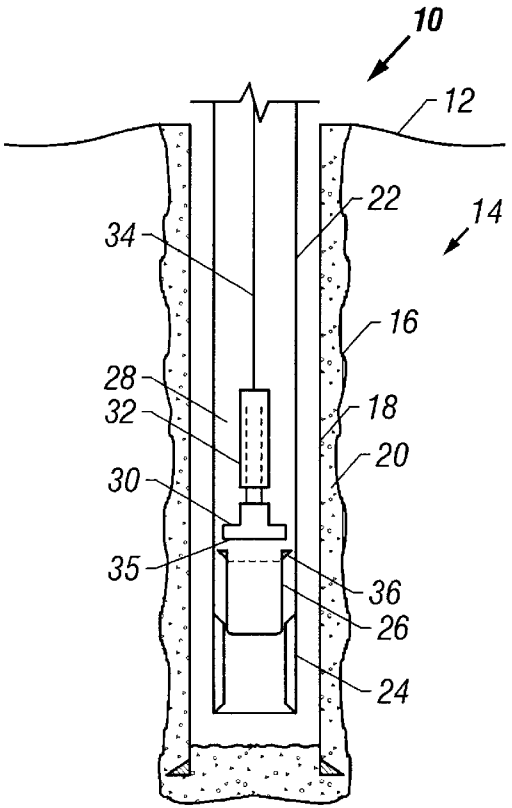
FIG. 1 (Prior Art)
FIG. 1 illustrates a prior art shifting tool used to actuate a downhole tool.

FIG. 1 illustrates a simplified well 10 drilled from a surface 12 into a subterranean formation 14. The wellbore 16 has a casing 18 that is cemented 20 in place. A tubular string 22 has a downhole tool 24 attached that includes a sliding sleeve 26. The sliding sleeve 26 is shown in its upper position. In this illustration, a shifting tool 28 comprises a contact device 30 and hydraulic or mechanical activated jars 32. The shifting tool 28 is shown run into the well on a wireline 34. The contact device bottom surface 35 contacts the sliding sleeve upper ledge 36. The contact device 30 and jars 32 act to impart a downward force onto the sliding sleeve 26, thus moving the sliding sleeve to its lower position.

Figure 2:
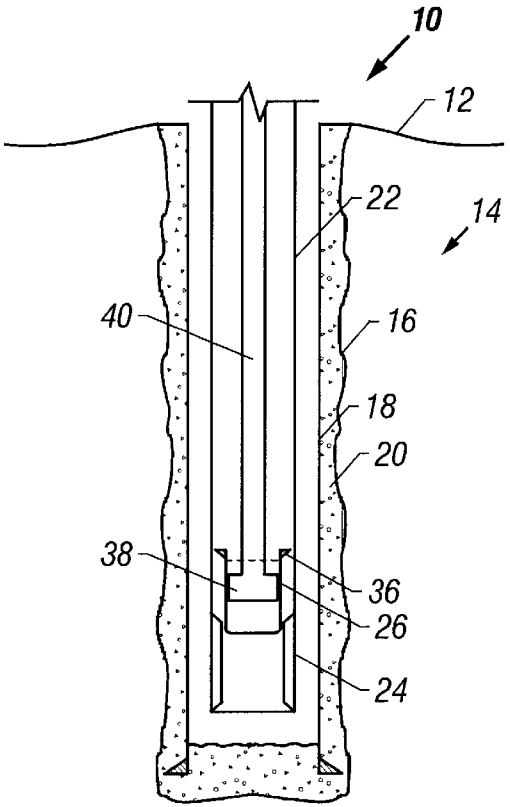
FIG. 2 (Prior Art)
FIG. 2 illustrates a prior art shifting tool used to actuate a downhole tool.

FIG. 2 illustrates a well 10 having a downhole tool 24 with a sliding sleeve 26. A shifting tool 38 is shown run on a tubing string 40, positioned inside the sliding sleeve 26, where it can be engaged with the sliding sleeve 26. A downward force from the tubing string 40 can then be transferred to the sliding sleeve 26, moving the sliding sleeve downward.

Figure 3:
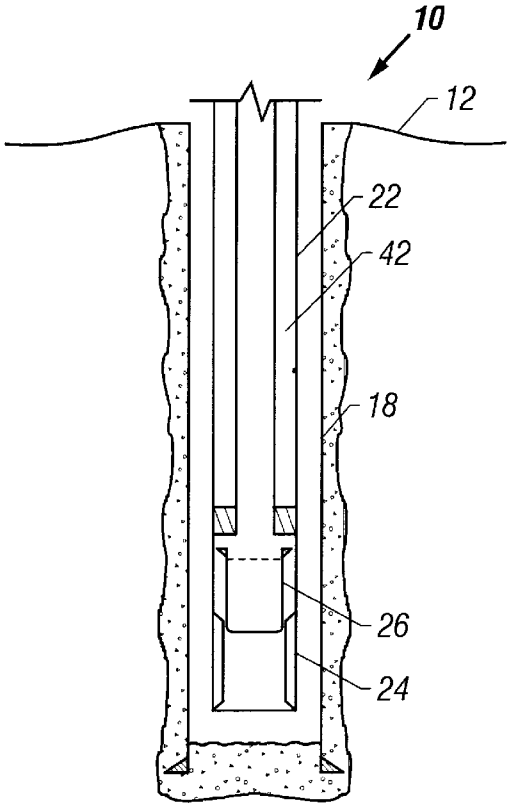
FIG. 3 illustrates a well having a tubing with restricted diameter above a downhole tool.

FIG. 3 illustrates a well 10 having a downhole tool 24 with a sliding sleeve 26. Above the sliding sleeve 26 is a tubular string 42 having an inner diameter that is less than the sliding sleeve. A tubular having an inner diameter that is less than a tubular or downhole tool located below it can be referred to as a restricted diameter tubular and may be referred to as such within this application. The prior art shifting tools such as shown in FIGS. 1 and 2 would not work in the FIG. 3 example having a restricted diameter tubular.

A prior art expandable shifting tool comprising an expandable elastomeric element could be run through the restricted diameter tubing string, inflated within the sliding sleeve, and used to move the sliding sleeve to its preferred position. The expandable elastomeric element could then be deflated and withdrawn, however there is an element of risk whenever an inflated element is used. The elastomeric element may not deflate to a sufficient extent to enable it to pass through the tubular string. Also, there is always a chance of the elastomeric element becoming torn or otherwise damaged such that it will not pass through the tubular string, resulting in time consuming and costly remedial measures.

FIGS. 4A–4D illustrate an embodiment of the present invention showing an expandable shifting tool 50. The tool has a longitudinal axis 44 and a radial axis 46. The tool 50 comprises a housing 52 having a wall 54 and an outer surface 56. The tool shown comprises two expandable elements 58, also known as slips or dogs, a first slip 60 located near the connector 80 end of the tool and a second slip 62 located near the opposite end of the tool. The slips 58 are spaced axially apart along the longitudinal axis 44 (on different radial planes). The slips 58 have a first surface 64 that can have a profile 66 and extend beyond the housing outer surface 56. In an embodiment of the invention each slip is capable of extending a distance greater than 50 percent of the housing diameter beyond the housing outer surface. An embodiment having two slips on opposite sides of the tool, or about 180 degree phasing from each other, can act to extend the overall tool diameter to a distance in excess of 150 percent of the housing diameter. This extended reach of the slips of the present invention provides a way to operate embodiments of the invention in applications where mechanical shifting tools could not operate before. Multiple slips can be utilized and can be located at phasing other than 180 degrees, for example 90 or 120 degree phasing between adjacent slips may be preferred in particular applications. The phasing between slips can be between about 90 degrees to about 180 degrees. The ability of each slip to independently operate with an extended reach as detailed above enables embodiments of the invention to successfully operate within wellbores that are deviated from vertical. Even downhole tools located in horizontal wells can be actuated with certain embodiments of the present invention, an example is shown in FIG. 5B. The slips 58 can have a second surface 68, a portion of which can fit into openings 70 within the housing wall 54. The ability of a portion of the slip 58 to locate within openings 70 in the housing wall 54 when in its retracted position enables the slip to have a greater height than conventional slip design. The greater height of the slip results in a greater radial projection when in its extended position.

Conventional slip assemblies comprise a plurality of slips located within the same radial plane. To enable the slips to collapse inward into the housing, each slip height must be equal to or less than the radius of the housing. In this way two opposing slips can contact each other in the center of the housing when both are in their collapsed position. An example of this can be seen in FIG. 8B. If there are more than two slips in the same radial plane, for example three slips with 120 degree spacing, the slips must have heights less than the radius of the housing for all three to be enclosed within the housing in their retracted position.

Figure 4A:
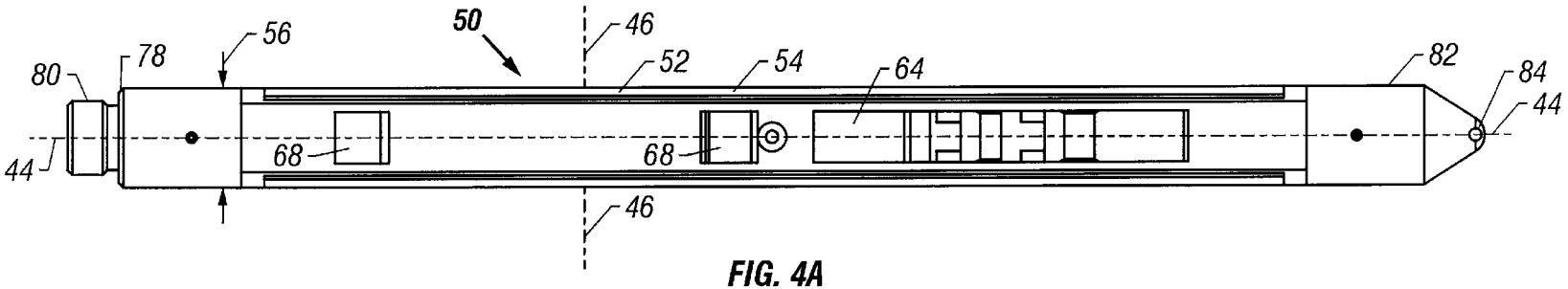
FIGS. 4A–4D illustrate an embodiment of the invention.
Figure 4B:
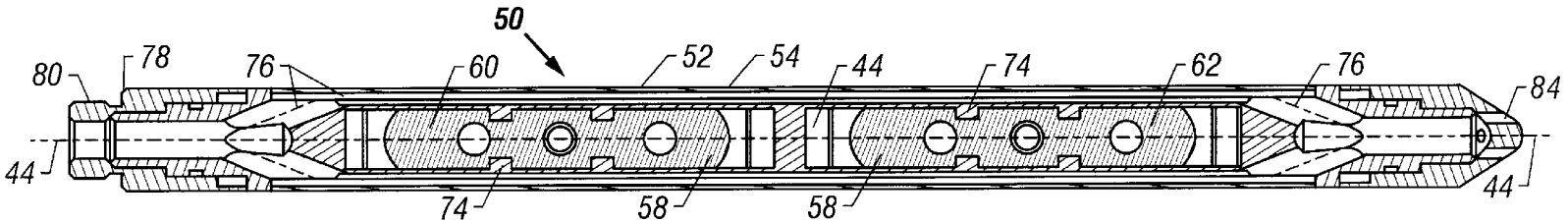
Figure 4C:
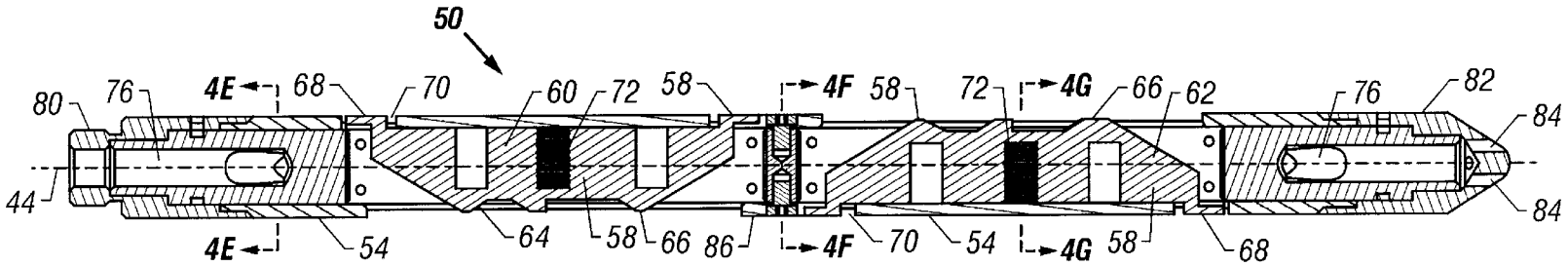

In embodiments of the present invention, the ability of the back surface 68 to extend into a housing opening 70, as shown in FIGS. 4A–4C, together with the fact that the slips are spaced axially apart along the longitudinal axis 44 allows the slips 58 to extend beyond the housing outer surface 56 and to have a height equal to the housing outer surface. This is turn enables an outward projection of the slips 58 that is greater than the projections achieved by conventional slip assemblies. The slips 58 are biased outward by means of springs 72 or other biasing means and are kept in alignment and guided by lug elements 74 that are in alignment with recesses 75 within the slips 58.

It is often desired to circulate fluid through the shifting tool. An example is when sand or deposits must be circulated out of the well to enable the shifting tool to reach the required depth. Certain embodiments of the present invention include one or more longitudinal passageways 76 that proceed through the tool 50 (and slips 56) within the housing 52 providing fluid communication between the ends of the tool, examples of which are shown in FIGS. 4B–4G. Removable retaining plates 86, affixed by screws 88 or other attaching means, enable the slips to be inserted and retained within the housing 52. Multiple slip assemblies can be connected to form a shifting tool having more than two slips.

As shown, the proximal end 78 of the tool has a connector 80, for example, a threadable connection, that can attach the tool to a tubular workstring, wireline, slickline or other means of deploying the tool. The distal end 82 comprises discharge nozzles 84 that can pass fluid from the passageways 76. The discharge nozzles 84 can be helpful when washing down the workstring or circulating debris from the wellbore is needed. The two slips 58 are located in different axial planes, thus allowing independent operation and an extended protrusion. The profiles of each slip can be different so that they will only engage with a correct matching profile.

Figure 5A:
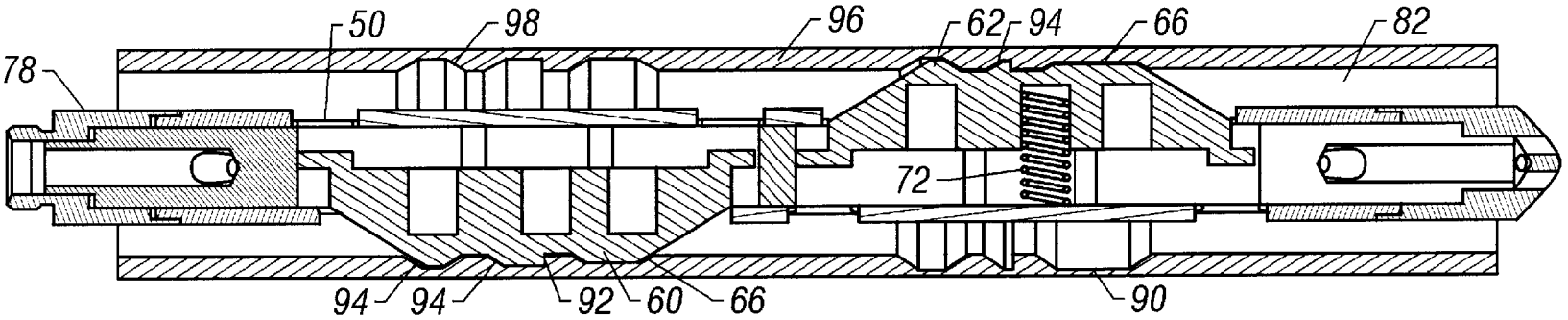
FIGS. 5A–5B illustrate an embodiment of the invention engaged within a downhole tool.
Figure 5B:
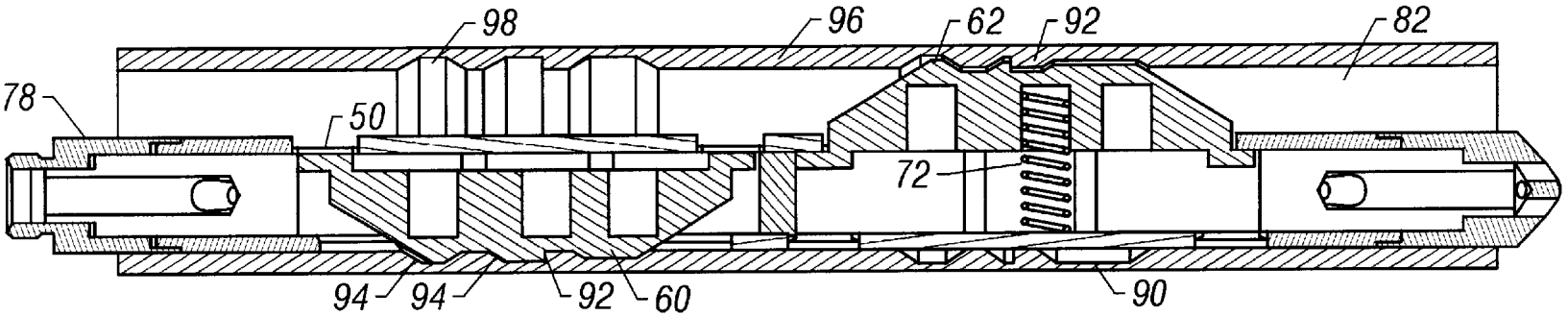

FIGS. 5A–5B show an embodiment of the shifting tool 50 located within and engaged to a downhole tool 96. The second end 82 is inserted first within the downhole tool 96. The second slip 62 did not have a matching profile with the first profile 98 in the downhole tool 96 and therefore passed through without engaging. When the second slip 62 profile of the shifting tool 50 encountered the second profile 90 of the downhole tool 96, the profiles did match and the two profiles engaged each other. Likewise, when the profile of the first slip 60 encountered the first profile 98 of the downhole tool 96, the first profiles engaged each other. Spring elements 72 bias the slips outward. A coiled spring element is shown but other biasing means can be used and are known to those skilled in the art. The profiles as shown are capable of transforming a downward force onto the downhole tool due to the angled edge 92 of the slip engaging with the matching profile of the downhole tool 96. Once the downhole tool has been actuated, the shifting tool can be withdrawn. The sloped back edges 94 allow the slips 60, 62 to retract as force is applied upward. The example above describes an embodiment of the invention used to engage with a downhole tool. It should also be noted that it is possible for the shifting tool to engage with one or more profiles located within the well casing or some other tubular located in the well. Depending on the design of the profiles it is possible for the shifting tool to apply a downward force only, an upward force only, and both an upward and downward force. The angles of the profiles can be designed to releasably engage, for example, to engage when the shifting tool mates with its matching profile but to disengage upon the imposition of a known force. These aspects are known to those skilled in the art.

FIG. 5A illustrates the shifting tool 50 positioned generally centered within the downhole tool 96 and shows the two slips 60, 62 each extended about half of the possible projection distance. This illustration shows the shifting tool used in a well having an orientation at or near vertical or where there is a means of centralizing the shifting tool within the downhole tool.

FIG. 5B illustrates the shifting tool 50 lying against the wall of the downhole tool 96. This could occur in horizontal or highly deviated wells. The same operating mechanisms apply as in FIG. 5A except the projection of the second slip 62 is at a maximum to reach the downhole tool 96 wall and its matching profile 90, while the first slip 60 is only slightly extended to engage its mating profile 88. FIG. 5B illustrates how an extended projection of the second slip 62 allows the engagement of both the second slip 62 and first slip 60 within the downhole tool 96, thereby increasing the chances for a successful actuating of the downhole tool 96. Some embodiments of the present invention enable the engagement of both opposing slips with the downhole tool in horizontal or highly deviated wells in ways that are not possible with the prior art. On the other hand, in a horizontal or highly deviated well wherein prior art shifting tools would be lying against the wall, conventional slip assemblies would not be able to engage all of the relevant profiles (and specifically the profiles at the opposite side of the wall) due to the restricted expansion of such slips.

Figure 6:
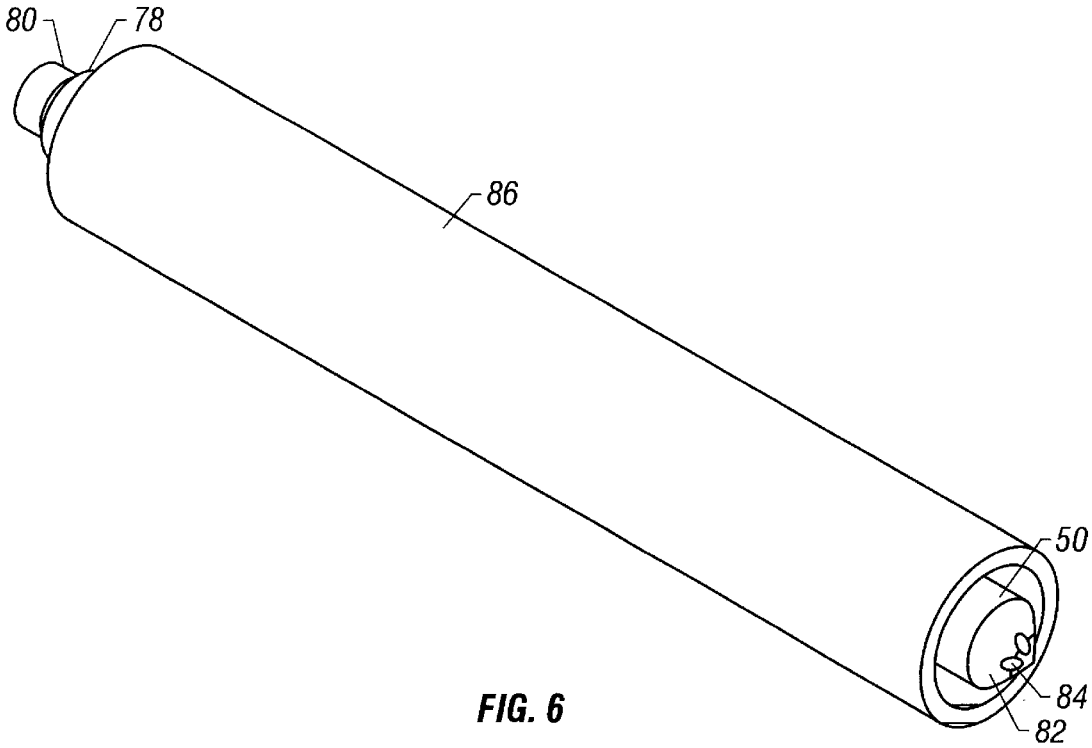
FIG. 6 shows an embodiment of the invention located within a segment of a downhole tool.

FIG. 6 shows a shifting tool 50 located within a portion of the downhole tool 86 or a section of casing. The second end 82 of the shifting tool 50 is shown having discharge ports 84 that can be used to circulate fluids through the shifting tool 50. The first end 78 of the shifting tool is also seen having the connector 80 that can be attached to a workstring or other deployment device.

Figure 7:
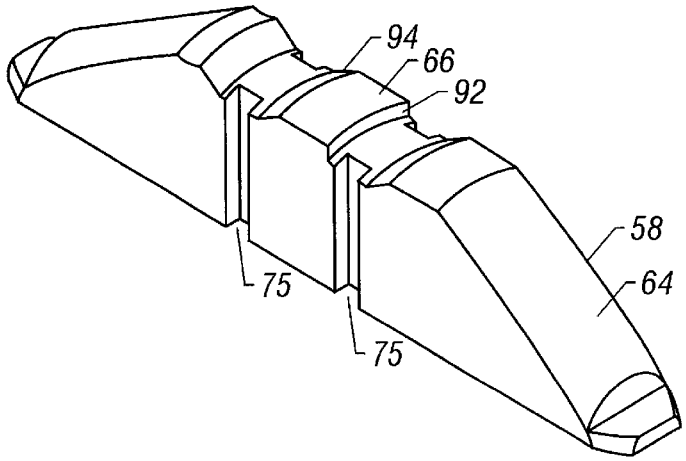
FIG. 7 illustrates an embodiment of a slip.

FIG. 7 shows a single slip 58 having an outer surface 64 that defines a profile 66. Recesses 75 are located on the sides to guide and align the slip 58 as it moves. The profile 66 comprises an angled edge 92 that can transmit force to a mating profile (as shown in FIG. 5A), and sloped edges 94 that allow the slip 58 to move within a downhole tool. With proper design of the slip profile 66, a slip can be used to transmit force to a downhole tool in a downward direction, in an upward direction and in both a downward and upward direction and still retain the ability to release from the downhole tool. One design known to those skilled in the art is to have a slight slope to the angled edge 92, whereby a certain force can be transmitted while the profiles are engaged, but where the profiles would disengage and the slip retract upon a further increase in the force. This would enable a tool to be actuated by an upward pull, then an increase in the is upward pull would release the shifting tool to be removed from the wellbore.

Figure 8B:
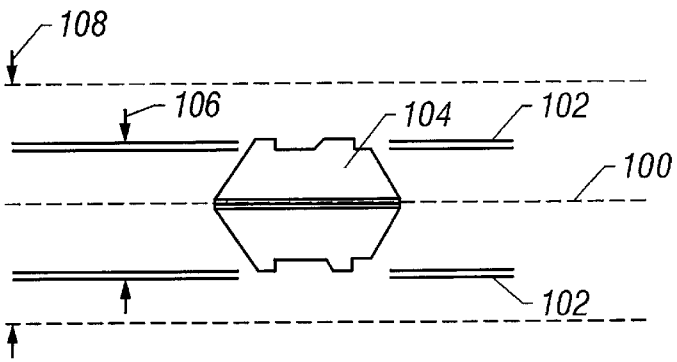
FIG. 8B (Prior Art)
FIGS. 8A–8B show the expansion capabilities of differing shifting tools.
Figure 8A:
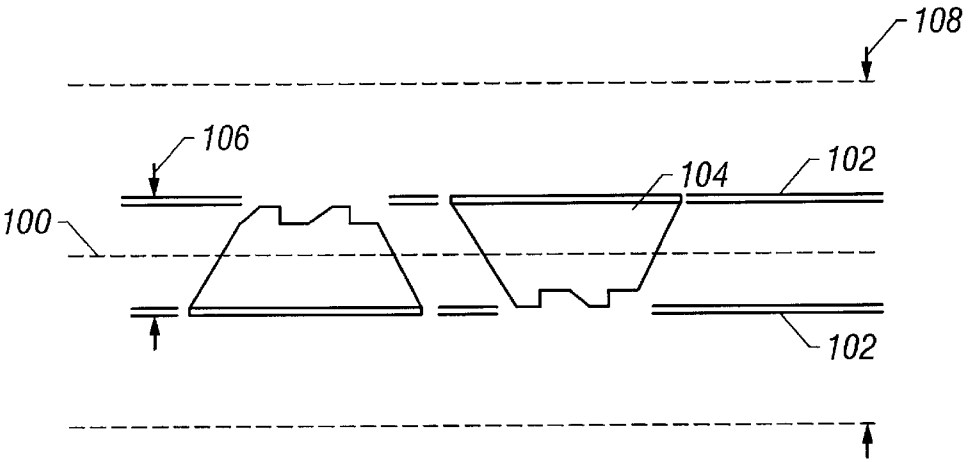

FIGS. 8A–8B illustrate the greater extension capacity of the slip elements of the present invention. A longitudinal centerline 100 is shown through the tool housing 102. Two slip elements 104 are shown in their retracted position. FIG. 8A shows the slips located in separate radial planes while FIG. 8B shows the slips in the same radial plane. A retracted tool diameter 106 is the minimum diameter that the tool can have when both slips 104 are in their retracted position. The tools shown in FIGS. 8A and 8B have the same minimum diameter 106. An expanded tool diameter 108 shows the maximum extent that the tool can achieve having both slips 104 in their greatest extended position. It can be seen that the maximum extension 108 in FIG. 8A, which has slips in different radial planes, is significantly greater than the maximum extension 108 achieved in FIG. 8B, where the slips are located in the same radial plane. The tool as shown in FIG. 8A has greater capability to expand than the tool shown in FIG. 8B, therefore it will have a greater capability to engage and actuate a downhole tool or profile than the tool of FIG. 8B. This capability for extended reach can be particularly important when the tool is used to actuate a downhole tool located below a well restriction.

Figure 4D:
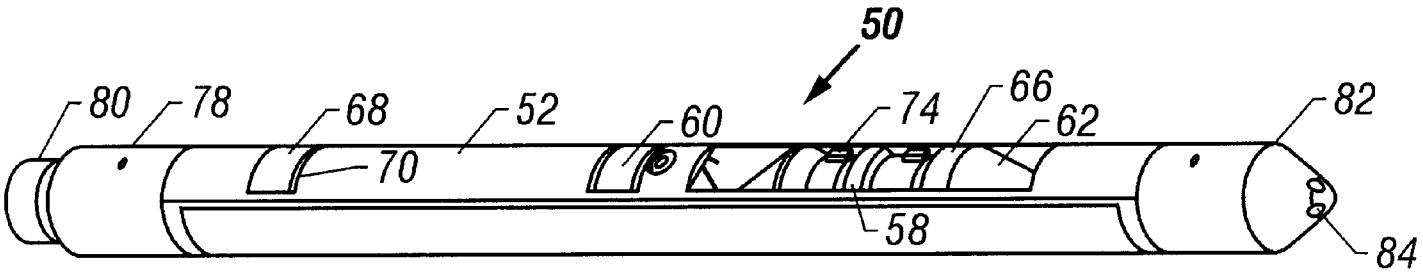
Figure 4G:
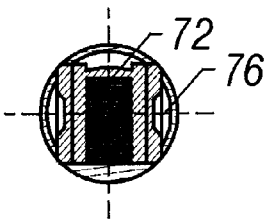
FIG. 4G is a cross sectional view of FIG. 4C designated by C—C.
Figure 4F:
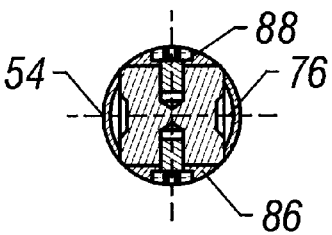
FIG. 4F is a cross sectional view of FIG. 4C designated by B—B.
Figure 4E:
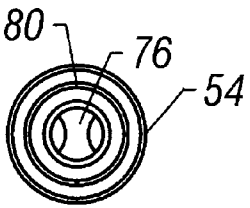
FIG. 4E is a cross sectional view of FIG. 4C designated by A—A.

In operation, the shifting tool 50, an example of which is shown in FIG. 4D, is inserted into a wellbore. The second end 82 is inserted first, followed by the first end 78 that comprises connection means 80 that are attached to deployment means such as a tubular string. The slip elements 58 are biased outward but are able to retract within the tool housing 52 when they encounter a restriction. The leading edges of the slips 58 are angled so as to collapse the slip within the housing and allow passage through the restriction. When the shifting tool 50 emerges from the restriction, the slips again extend due to their bias outward. Wash ports 84 are shown in the second end 82 of the shifting tool 50 that are connected to passageways (76 in FIG. 4B) that enable fluid circulation through the shifting tool 50. By circulating fluid through the shifting tool 50 sand or other debris that may inhibit the insertion of the shifting tool 50 can be circulated out of the well.

Referring to FIG. 5A, if the slip profile 66 comes in contact with a downhole profile such as 98 that is not matching, the slip 62 will not extend into the downhole profile 98 and will pass without engaging. If the slip profile 66 comes in contact with a downhole profile such as 90 that matches, the slip 62 will extend into the downhole profile 90 thus engaging the matching profiles. FIG. 5A illustrates the ability to have differing slip profiles 66 that engage only with a matching profile on the downhole tool 96. In this illustration the first slip 62 engages with profile 90 while the second slip 60 engages with profile 98. Once the shifting tool 50 has engaged the downhole tool 96, a force can be applied to the shifting tool 50 and transmitted to the downhole tool 96, thus effecting a mechanical actuation of some kind. After the desired actuation has been achieved, the shifting tool 50 can be disengaged from the downhole tool 96 with a force applied to the shifting tool 50. In the example shown in FIG. 5A a movement of the shifting tool 50 towards the first end 78 would apply an inward force onto the slips 60, 62 and compress the spring element 72, allowing the slips to retract and disengage from their matching profiles. The shifting tool 50 can then be removed from the well, the slips collapsing when passing through any restrictions in a manner as described above due to the angled leading edge of the slips.

Some of the discussion and illustrations within this application refer to a vertical wellbore that has casing cemented in place. The present invention can also be utilized to complete wells that are not cased and likewise to wellbores that have an orientation that is deviated from vertical.

The particular embodiments disclosed herein are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

What is claimed is:

1. An expandable shifting tool, comprising:

a housing having an outer surface; and a plurality of radially extendable elements longitudinally separated from each other, such that only one of the plurality of radially extendable elements is disposed within any given length of die tool;

wherein the extendable elements arc capable of moving between an extended position and a refracted position.

2. The shifting tool of claim 1, wherein the extendable elements comprise a first surface and a second surface, the first surface comprising an end of the extendable element which protrudes radially outside of the housing outer surface when in its extended position.

3. The shifting tool of claim 2, wherein the first surface extends no further radially than the outer surface of the housing when in the retracted position.

4. The shifting tool of claim 2, wherein the second surface of the extendable element extends no further radially than the housing outer surface when the extendable element is in its retracted position.

5. The shifting tool of claim 4, wherein the housing comprises a wall comprising openings that enable a portion of the second surface of the extendable element to locate within the wall opening when the extendable element is in its retracted position.

6. The shifting tool of claim 1, wherein each extendable element is capable of protruding beyond the housing outer surface a distance greater than 50 percent of the housing outer surface diameter length.

7. The shifting tool of claim 1, wherein the housing is cylindrical and each extendable element is located on the opposite side of the tool from an adjacent extendable element.

8. The shifting tool of claim 1, wherein each extendable element is at least partially contained within the housing and is biased towards the extended position.

9. The shifting tool of claim 1, wherein the shifting tool comprises a first end and a second end and at least one passageway capable of communicating fluid between the first end and the second end within the shifting tool housing.

10. The shifting tool of claim 9, wherein the first end comprises a connection that is capable of connecting to a deployment device and the second end comprises fluid outlet ports capable of discharging fluid from the at least one passageway through the tool.

11. The shifting tool of claim 1, wherein the extendable elements and tool housing comprise alignment elements that guide the extendable elements as they move between their retracted and extended positions.

12. The shifting tool of claim 1, wherein each extendable element is capable of moving between the retracted and extended position independent of any other extendable element.

13. The shifting tool of claim 2, wherein the first surface of the extendable element comprises a profile that is capable of engaging a mating profile.

14. The shifting tool of claim 13, wherein each extendable element first surface profile is different than the first surface profiles of the other extendable elements.

15. A shifting tool comprising:

a generally cylindrical housing comprising a wall, an outer diameter, a first end and a second end;

a plurality of anchor slips at least partially located within the housing and comprising a first surface and a second surface, the anchor slips located in separate radial planes from each other and capable of moving independently between a retracted position and an extended position;

at least one longitudinal passageway within the housing capable of providing hydraulic communication between the first end and the second end of the tool; and wherein the anchor slips in their extended position are each capable of extending beyond the outer diameter of the housing a distance in excess of 50 percent of the housing diameter.

16. The shifting tool of claim 15, wherein the anchor slips are biased towards the extended position.

17. The shifting tool of claim 15, wherein the anchor slips and tool housing comprise alignment elements that guide the anchor slips as they move between their retracted and extended positions.

18. The shifting tool of claim 15, wherein the anchor slips in their retracted position does not extend beyond the outer diameter of the tool housing.

19. The shifting tool of claim 15, wherein the tool housing comprises openings within its wall that are capable of containing a portion of the second surface of an anchor slip when the anchor slip is in its retracted position.

20. A shifting tool comprising:

a generally cylindrical housing comprising a wall and an outer diameter;

a plurality of latching members at least partially disposed within the housing, the latching members capable of moving independently between an inner position and an outer position, thereby defining a tool diameter;

wherein when the latching members are in their outer position the tool diameter is capable of being in excess of 200 percent of the housing diameter.

21. The shifting tool of claim 20, wherein the latching members comprise a profile that is capable of engaging a mating profile and each latching member profile capable of being different than the other latching member profiles.

22. The shifting tool of claim 20, wherein the latching members are biased to the outer position with a spring element.

23. The shifting tool of claim 20, wherein the latching members comprise alignment lugs that guide the latching members as they move between their inner and outer positions.

24. The shifting tool of claim 20, wherein the latching members are located in separate radial planes from the other latching members.

25. The shifting tool of claim 20, wherein when a latching member is in its inner position the latching member is contained within the housing outer diameter.

26. The shifting tool of claim 20, wherein the housing wall comprises openings wherein when a latching member is in its inner position a portion of the latching member is located within the opening of the housing wall.

27. The shifting tool of claim 20, further comprising:

at least one passageway longitudinally through the tool within the housing providing fluid communication through the tool.

28. The shifting tool of claim 27, wherein the tool comprises a first end and a second end, the first end comprising a coupling capable of connecting to a deployment device and the second end comprising at least one nozzle capable of discharging fluid from the at least one passageway.

29. A downhole assembly comprising:

a shifting tool comprising a housing having an outer diameter, a plurality of radially extendable slips longitudinally separated from each other, each slip being at least partially contained within the housing, outwardly biased and capable of acting independently; and a downhole profile adapted to releasably engage with the shifting tool, wherein each of the plurality of slips are capable of extending through the housing a distance in excess of 50 percent of the outer diameter of the housing.

30. The downhole assembly of claim 29, wherein the shifting tool slips comprise a profile that engages with the downhole profile.

31. The downhole assembly of claim 29, wherein the shifting tool comprises at least one fluid passageway within the shifting tool housing capable of communicating fluid through the shifting tool.

32. The downhole assembly of claim 29, wherein the downhole profile is a component of a downhole tool, the downhole tool adapted to releasably engage with the shifting tool and transmit a force applied to the shifting tool to the downhole tool.

33. The downhole assembly of claim 32, wherein the downhole tool is capable of being mechanically actuated from a first configuration to a second configuration.

34. An apparatus comprising:

a housing; and a plurality of slip elements longitudinally spaced from each other, such that only one of the plurality of slip elements is disposed within any given length of the housing, the plurality of slip elements being capable of extending radially from the housing;

wherein each slip comprises a profile that is capable of engaging a matching downhole profile.

35. The apparatus of claim 34, wherein the slip elements are spaced at about 180 degree phasing from the adjacent slip elements.

36. The apparatus of claim 34, wherein the slip elements are spaced at about 90 to 180 degree phasing from the adjacent slip elements.

37. The apparatus of claim 34, wherein the apparatus comprises a first end and a second end and at least one passageway capable of communicating fluid between the first end and the second end within the apparatus housing.

38. A method of actuating a downhole tool comprising:

providing an expandable shifting tool comprising a plurality of radially extending elements that are longitudinally separated from each other, such that only one of the plurality of radially extending elements is disposed within any given length of the tool;

inserting the shifting tool within the downhole tool;

engaging a profile on the extending elements with a matching profile on the downhole tool; and applying force to the shifting tool that is transferred to the downhole tool, thus actuating the downhole tool.

39. The method of claim 38, wherein the extending elements are biased in an outward position.

40. The method of claim 38, wherein each extending element has a different profile than the other extending elements.

41. The method of claim 38, wherein the shifting tool comprises at least one passageway whereby fluid can be circulated through the shifting tool to wash the shifting tool down to the downhole tool.

42. A method of actuating a downhole tool located below a restricted diameter tubular, comprising:

providing an expandable and collapsible mechanical shifting tool comprising a plurality of outwardly biased slips, the slips spaced in radially separated planes and being capable of extending a distance greater than 50 percent of an outside diameter of the expandable shifting tool;

inserting the shifting tool through the restricted diameter tubular and to the downhole tool;

engaging the slips of the shifting tool with the downhole tool;

actuating the downhole tool by movement of the shifting tool;

disengaging the shifting tool from the downhole tool; and removing the shifting tool through the restricted diameter tubular.

43. The method of claim 42, wherein the outer surfaces of the slips comprise a profile that is capable of releasably engaging with a matching profile in the downhole tool.

44. The method of claim 42, wherein each slip comprises a profile with a different pattern than the other slips.

45. The method of claim 42, further comprising:

circulating fluid through at least one passageway within the shifting tool to wash the shifting tool down to the downhole tool.

46. A method of actuating a downhole tool in a wellbore that is deviated from vertical, comprising:

providing an expandable shifting tool comprising a housing having an outer diameter, and at least two dog elements, each dog element capable of extending beyond the housing outer diameter a distance in excess of 50 percent of the housing diameter;

inserting the shifting tool into the wellbore;

engaging the shifting tool with the downhole tool; and actuating the downhole tool;

wherein the shifting tool is located eccentrically within the downhole tool.

47. The method of claim 46, further comprising:

circulating fluid through at least one passageway within the shifting tool to wash the shifting tool down to the downhole tool.

48. The method of claim 46, wherein the extendable dog elements comprise a profile that releasably engages with a matching profile on the downhole tool.

49. The method of claim 48, wherein one side of the shifting tool is in contact with the downhole tool and each dog element is capable of engaging with the matching profile on the downhole tool.

* * * * *

UNITED STATES PATENT AND TRADEMARK OFFICE

CERTIFICATE OF CORRECTION

PATENT NO. : 6,631,768 B2
DATED : October 14, 2003
INVENTOR(S) : Dinesh R. Patel et al.

It is certified that error appears in the above-identified patent and that said Letters Patent is hereby corrected as shown below:

Column 9,
Line 54, delete “arc” and insert -- are --.
Line 55, delete “refracted” and insert -- retracted --.

Signed and Sealed this

Twenty-eighth Day of September, 2004

JON W. DUDAS
*Director of the United States Patent and Trademark Office*